US006189308B1

(12) United States Patent
Dinkelmann et al.

(10) Patent No.: US 6,189,308 B1
(45) **Date of Patent: *Feb. 20, 2001**

(54) METHOD OF AND APPARATUS FOR PRODUCING A YARN ON A RING-SPINNING MACHINE

(75) Inventors: Friedrich Dinkelmann, Rechberghausen; Andreas Olbrich, Kirchheim, both of (DE)

(73) Assignee: Zinser Textilmaschinen GmbH, Ebersbach/Fils (DE)

( * ) Notice: Under 35 U.S.C. 154(b), the term of this patent shall be extended for 0 days.

This patent is subject to a terminal disclaimer.

(21) Appl. No.: 09/285,585

(22) Filed: Apr. 2, 1999

(30) Foreign Application Priority Data

Apr. 3, 1998 (DE) ..... 198 15 052

(51) Int. Cl.[7] ..... D01H 5/785

(52) U.S. Cl. ..... 57/76; 57/315; 57/75; 19/246; 19/266; 19/288

(58) Field of Search ..... 57/75, 76, 315, 57/328; 19/244, 246, 288

(56) References Cited

U.S. PATENT DOCUMENTS

| | | | | |
|---|---|---|---|---|
| 5,651,244 | * | 7/1997 | Lucca et al. | 57/75 |
| 5,915,510 | * | 6/1999 | Dinkelmann et al. | 19/288 |
| 6,029,318 | * | 2/2000 | Dinkelmann | 19/244 |
| 6,032,451 | * | 3/2000 | Dinkelmann | 57/315 |

FOREIGN PATENT DOCUMENTS

| | | |
|---|---|---|
| 882 066 | 7/1953 | (DE) . |
| 41 39 067 | 6/1993 | (DE) . |
| 44 26 249 | 2/1996 | (DE) . |
| 0 635 590 | 1/1995 | (EP) . |
| 1 490 473 | 10/1965 | (FR) . |

* cited by examiner

*Primary Examiner*—John J. Calvert
*Assistant Examiner*—Shaun Hurley
(74) *Attorney, Agent, or Firm*—Herbert Dubno

(57) ABSTRACT

A yarn is produced by condensing and compacting the roving after its passage through a drafting frame by suction rollers or suction belts and then twisting and winding up the yarn without the formation of a thread balloon on a ring spinning station with a balloon-limiting finger or crown.

14 Claims, 5 Drawing Sheets

METHOD OF AND APPARATUS FOR PRODUCING A YARN ON A RING-SPINNING MACHINE

CROSS REFERENCE TO RELATED APPLICATION

This application is entitled to the benefit of Ser. No. 09/285,584 filed Apr. 2, 1999 (U.S. Pat. No. 6,032,451 of Mar. 7, 2000).

FIELD OF THE INVENTION

Our present invention relates to a method of and to an apparatus for the production of yarn. More particularly, the invention relates to a method of producing a yarn in which roving supplied by a drafting frame is subjected to condensing (compaction) and is then twisted and collected at a ring-spinning station of the ring-spinning machine. The invention also relates to the ring-spinning machine which is used for that purpose.

BACKGROUND OF THE INVENTION

A spinning machine can comprise a drafting frame and a multiplicity of spinning stations, the drafting frame comprising a number of roller pairs through which the roving passes for drafting or drawing between the roller pairs which can be operated at successively higher peripheral speeds. The lower rollers of the roller pairs may be continuous, i.e. rollers that extend the full length of the drafting frame, while the upper rollers or pressing rollers may be mounted in the weighting or loading arm and can be specific to the particular spinning station. Twinned upper rollers are commonly also provided, i.e. each arm may press two upper rollers against one of the continuous lower rollers.

At each spinning station the roving or, where two or more rovings are supplied to a given station, the plurality of rovings thus supplied, are twisted and wound up in a yarn body.

A condensing or compacting system for a roving or slubbing can be provided as described in German patent document DE 44 26 249 A1 or EP 0 635 590 A2. In the first case, the condensing device is in the form of a rotatable cylindrical roller (suction roller) which is provided along its periphery with a row of perforations. In the system of EP 0 635 590 A2, the row of perforations is provided on an endless flexible belt and suction can be applied to these perforations as well (suction belt).

The condensing or compaction operation applied to a roving delivered by a drafting frame, has the advantage of drawing the roving together so that when it enters the twisting zone it is substantially more compact than when, as sliver or slubbing, it arrives at the drafting frame. Since the roving before it reaches the twisting zone is more tightly defined by reason of the condensing or compaction steps, the twist tends to jump practically to the nip of the last roller pair in the path of the yarn before the spinning station and the so-called "spinning triangle" can be relatively small. Losses of edge fibers from the yarn can be minimal and the number of fibers which project out of the yarn can be small as well so that the finished yarn has a low degree of hairiness.

OBJECTS OF THE INVENTION

It is the principal object of the present invention to provide an improved method of making yarn of low hairiness and high quality, whereby drawbacks of earlier systems are avoided.

Another object of the invention is to provide a method of producing yarn in which fiber losses during the yarn spinning process are held to a minimum.

It is still another object of the invention to provide an improved spinning machine for the purposes described.

SUMMARY OF THE INVENTION

We have now found that all of these objects can be obtained and yarn of improved quality can be produced when, after drafting of the roving or slubbing, the latter is subjected to a condensing operation as described and the resulting compacted roving is then twisted and collected in a yarn body utilizing a ring-spinning machine so constructed as to minimize thread-balloon formation. In other words, by providing the condensing device on the spinning machine immediately downstream of the drafting frame or as an integral part of the drafting frame immediately after the last roller pair thereof, we can take advantage of the reduction in peripheral fiber loss and the reduced hairiness of the product.

It has been found further that when, in conjunction the condensation with, the twisting and winding up of the yarn is carried out on a ring-spinning machine (equipped at each spindle with a thread finger or crown to reduce the thread balloon which is formed or eliminate it entirely), additional advantages can be obtained. The twisting and winding up of the yarn can be carried out on such a ring-spinning apparatus in a balloonless manner and with reduced yarn tension in the piece of yarn between the point at which the yarn is deposited in the yarn package and the output roller pair of the drafting frame by comparison with the yarn tension in a ring-spinning machine or the like in which the conventional substantial thread balloon generates a high tension. This effect of the reduced thread ballooning of the ring-spinning machine is in addition to or in support of the effect of the compaction of the roving.

According to a feature of the invention the condensing or compaction operation is carried out before twisting is imparted to the roving. According to a feature of the invention the spinning machine can comprise:

- a drafting frame for drafting roving to produce drafted roving;
- a condensing device downstream of the drafting frame for compacting the roving to compacted roving;
- a ring-spinning station receiving at least one of the compacted rovings for twisting thereof to form a yarn and for collecting yarn in a yarn bobbin; and
- means for minimizing thread-balloon formation in the twisting of the compacted rovings.

In this ring-spinning machine, the condensing device can be provided on the drafting frame. The condensing device can be provided with a suction roller, i.e. a hollow rigid rotating body to which suction is supplied at its center and which is formed with a row of perorations applying suction to the roving. Where necessary or desirable, the suction can be applied through a flexible belt guided over a roller and which can be used to support the roving between the output rollers of the drafting frame and the roller about which the belt passes.

The ring-spinning stations can be of conventional construction for ring-spinning machines, but provided with a finger or crown at each station above the respective spindle for reducing or eliminating the thread balloon.

According to the invention, core yarn can be made utilizing the principles described above and mock yarn can be fabricated as well. Reference may be had to our commonly assigned copending application, Ser. No. 09/285,434, attorney's docket number 21049, filed concurrently herewith and based upon German application 198 15 053.9 filed Apr. 3, 1998.

For the fabrication of a core yarn, core threads should be as much as possible wholly embedded in the roving and the roving should be twisted so that the core yarn is not at all visible in the roving. In conventional core yarn spinning, there are gaps in the cover fibers through which the core yarn or thread may be visible or over which the application of the cover filaments may be incomplete, thereby leading to a reduction in the quality of the resulting core yarn. When a core thread is, in accordance with the invention, embedded in the roving prior to the condensing or compaction step, it has been found that the coverage of the core thread is far more complete and hence the yarn is of higher quality. Indeed, it has been found to be advantageous in this case to feed the core thread to the roving upstream of the condensing or compaction zone and where the roving is still relatively wide as such as possible centrally to the roving. This is especially the case where the core thread is supplied to the roving upstream of the output pair of rollers of the drafting frame. Of course, as an alternative, the core thread can also be fed directly to the condensing or compaction zone. It has been found to be advantageous to feed the core thread to a perforated belt extending from the last roller pair of the drafting frame as part of the condensing or compaction unit and to supply core thread from above or below so that it is delivered to the belt at the point at which the belt undergoes a change in direction proximal to the nip of the last roller pair of the drafting frame.

Alternatively, the belt can be provided at its inlet side with a guide roller so that the core thread is fed between this guide roller and the belt. When the condensing device has a suction roller, the core thread can also be fed to the periphery of the suction roller so that it can be held by suction thereagainst.

While each roving can receive a single core thread, it is also possible to supply a plurality of core threads to the roving and thereby form a core yarn when the roving is twisted. Two or more rovings, each provided with one or more core threads, can be collected before the twist is imparted and the yarn formed so that by imparting the rotation or twist to the combination, a so-called sock yarn with two core threads can be produced.

The term "mock yarn" is here used in the sense described in the earlier application to refer to a yarn in which the two rovings or slubbings which are joined have little or no twist prior to being united into the "mock yarn" and are then twisted together so that the rovings are intertwined. In true yarn, by contrast, the elements which are twisted together are previously twisted themselves so that they can be distinguished in the spun yarn. In the mock yarn to which reference is made here, the individual rovings have no intrinsic twist although they are twisted together as is the case with a true yarn.

A mock yarn is similar in appearance to the true yarn to the extent that the two components of the mock yarn are individually recognizable. The condensing or compaction step of the present invention assists in enabling the two rovings to be distinguished from one another in the yarn so that the mock yarn more closely resembles a true yarn than has been the case heretofore with such mock yarns. The two rovings, because of the compaction, remain separately distinguishable from one another.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
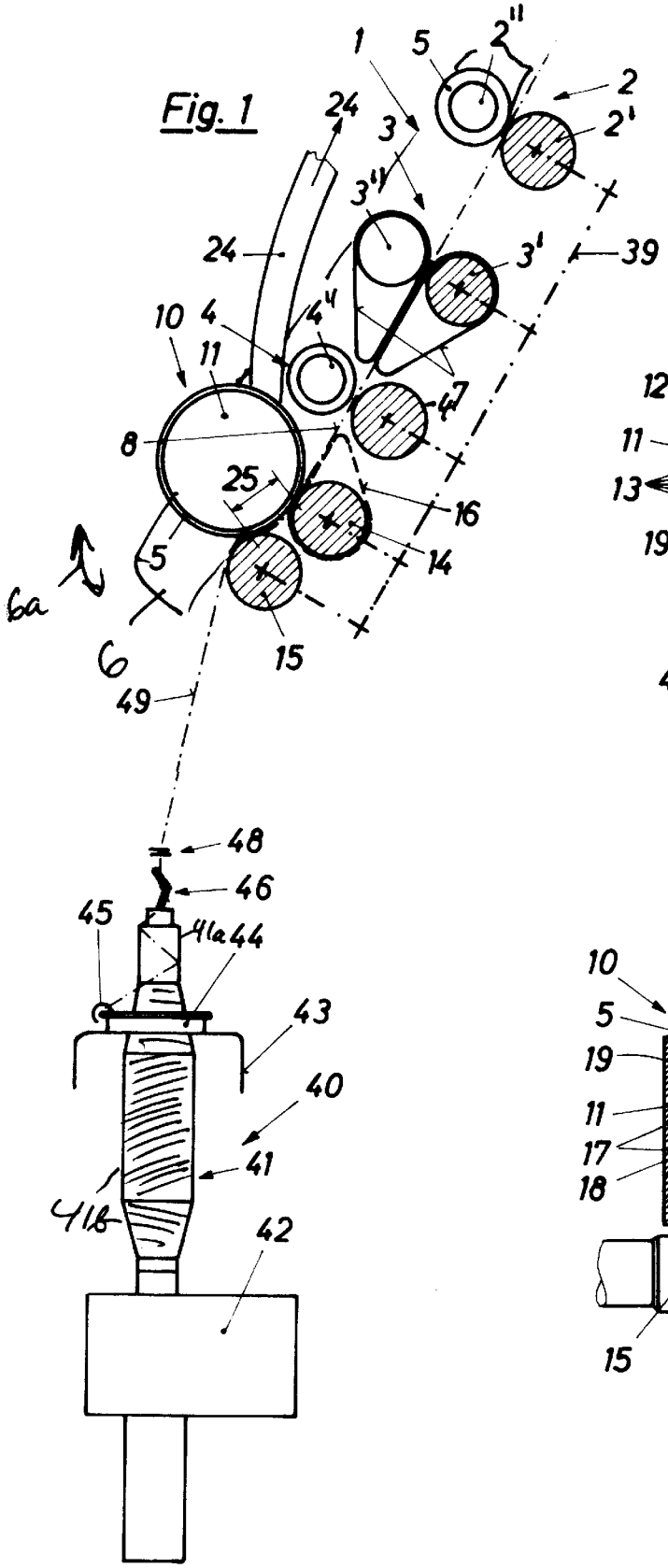
FIG. 1 is a transverse section through a spinning machine according to the invention, in highly diagrammatic form, showing the combination of the drafting rollers, the condensing or compacting unit and the ring-spinning station.
Figure 2:
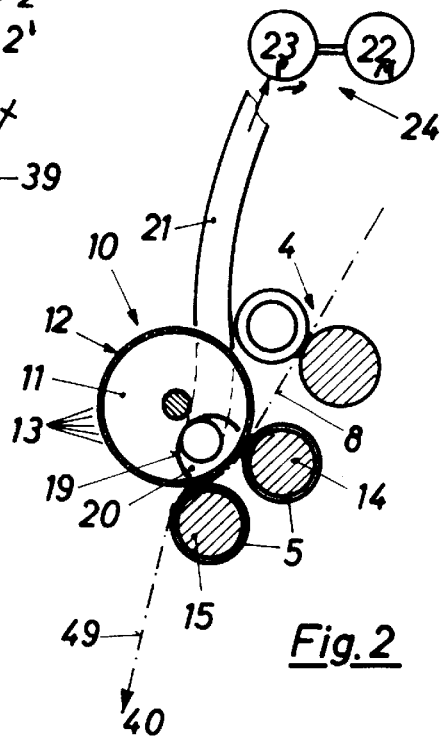
FIG. 2 is a detail showing a modification of the condensing or compaction unit of FIG. 1, partly broken away.
Figure 3:
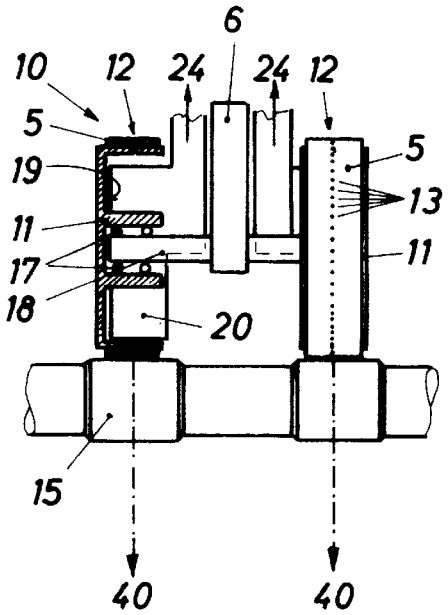
FIG. 3 is a front view, partially broken away, with a portion of the condensing unit of FIGS. 1 and 2.

The spinning machine illustrated in FIGS. 1–3 comprises a drafting frame 1 having, in the usual manner, an upstream or intake roller pair 2 formed by a lower roller 2' and an upper roller 2", an intermediate roller pair 3 formed by a lower roller 3' and an upper roller 3" and an output roller pair 4 formed by lower and upper rollers 4' and 4" respectively, the rollers being driven at progressively higher speeds in engagement with the roving so that the roving is progressively stretched between the roller pairs.

The lower rollers 2', 3' and 4' of these roller pairs are formed as steel rollers extending the full length of the drafting region of the spinning machine and can have, at working stations corresponding to the spinning stations, milling or knurling to ensure effective gripping of the roving.

The lower rollers can be provided with a common drive 39 which operates them at progressively higher speeds along the path of the roving and can be steel rollers.

The upper rollers 2", 3" and 4" are each formed as part of a twin roller set (such a twin roller having been shown in FIG. 3) mounted on an upper arm 6 which is swingable as shown by the arrow 6*a* and is weighted or spring loaded to press the upper rollers against the roving as it is supported by the lower rollers.

The upper roller, as has been shown for rollers 2" and 4", can be provided with elastic jackets 5 and can be mounted with some freedom of play on the arm 6 so that they are self oriented when brought into engagement with the roving.

The arm 6 can be spring loaded if its weight is not sufficient to provide a satisfactory force on the roving.

The rollers 3' and 3" of the middle roller pair 3 are equipped with belts 7 which can be guided on respective cages (not shown) and flank the roving in the main stretching zone between the intermediate roller pair 3 and the output or final roller pair 4.

In operation, the drafting frame 1 supplies a fully stretched fiber roving 8 to a final stage of the drafting frame which is formed as a condenser for compaction of the roving. Before reaching the compactor or condenser unit 10, the fully stretched roving is not stabilized by twisting. The drafting system can be of another type if desired.

What is important to the present invention is that the drafting frame is upstream of a condensing or compaction unit 10 which is capable of compacting the drafted or drawn roving 8.

In the embodiment of FIGS. 1–3, the condensing unit comprises a suction roller 11 located above the roving 8 and hence above the stretching plane of the drafting frame. FIGS. 2 and 3 show the suction drum in section and at an orientation at right angles to the views of FIGS. 1 and 2, respectively. The suction roller 11 is formed with a perforated perimeter 12 having a row of small, round or transversely extending elongated openings or orifices 13. Each roller 12 rests upon two driven lower rollers 14 and 15 between which a condensing stretch 25 is defined.

To prevent the roving from dropping before it enters the nip between the rollers 11 and 14 or from being deflected by a jet of air or incidental air currents, the lower roller 14 is provided with a transport belt 16, looped around the lower roller 14 and reaching practically to the nip between the rollers 4' and 4". The transport belt 16 carries the roving 8 and supports it until it is drawn into the condensing stage and prevents breakage of the roving by any jerky action which may be applied thereto.

As can be seen from FIG. 3, each suction roller 11 is cup-shaped and is journaled by bearing 17 on a respective axle 18 formed as a pin on the arm 6.

Through an open side of the suction roller 11, a shield 19 extends into the latter and defines a suction chamber 20 communicating with the orifices 13 previously described. The chamber 20 delimited by the shield 19 is evacuated through the pipe or hose 21 via a suction source 24 consisting of a pump 23 and a rotor 22.

The suction effect at the compaction zone is delivered to the periphery and serves to draw the filaments of the roving together. Outside of the compaction zone 25, the suction roller need not be under suction.

While the outer wall of the hollow suction roller 11 can be composed of steel, to avoid metallic contact between the suction roller 11 and the lower rollers 14 and 15 with consequent noise, an elastic jacket 5 is provided on the roller 10. In the embodiment of FIGS. 1 and 2, the suction roller 11 has the elastic jacket 5 while in FIG. 2 the lower roller 14 is provided with the elastic jacket.

Figure 4:
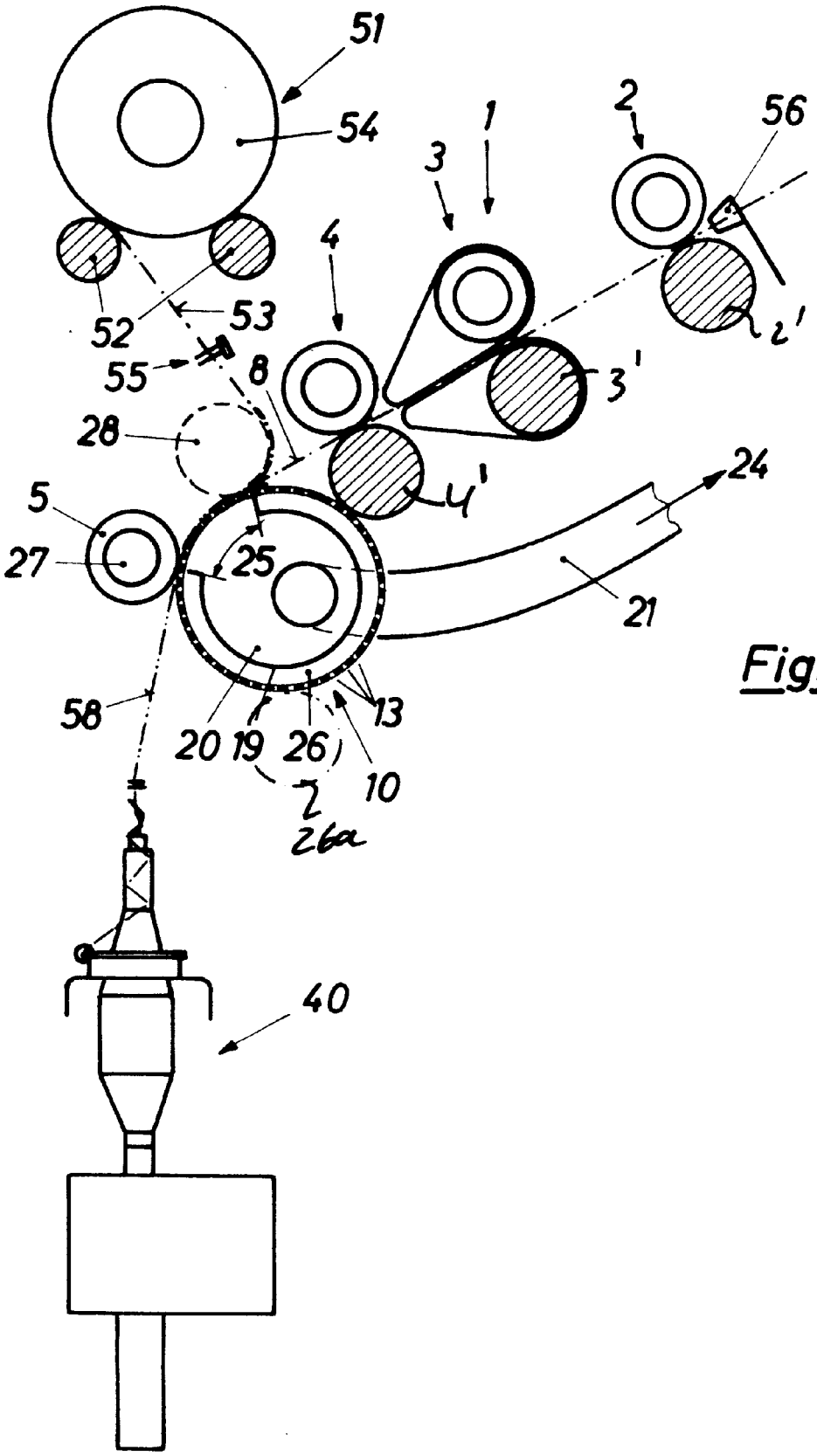
FIGS. 4–7 are views similar to FIG. 1 showing other embodiments of the apparatus.

FIG. 4 shows an embodiment in which the suction roller which can otherwise be similar to that described in FIG. 1 is located below the roving and can be formed as a driven lower roller. It may be driven by contact with the lower roller 4' of the output pair of rollers or by a further steel roller 26*a* also extending along the entire length of the drafting frame and driven with the rollers 2', 3' and 4' as has already been noted. The roller 26 is juxtaposed with at least one upper roller 27 at a nip serving as the twist stop for the yarn 38 twisted beneath it in a ring spinning frame, one spinning station of which is represented at 40. At the upstream side of the compaction zone a further upper roller 28 can be provided and both upper rollers 27 and 28 can be twinned rollers held in the loading arm 6 which also carries the upper rollers 2", 3" and 4".

The suction roller 26 contains a shield 19 which delimits a suction chamber. The latter can be evacuated through the tube 21 via the suction source represented here diagrammatically at 24.

Figure 5:
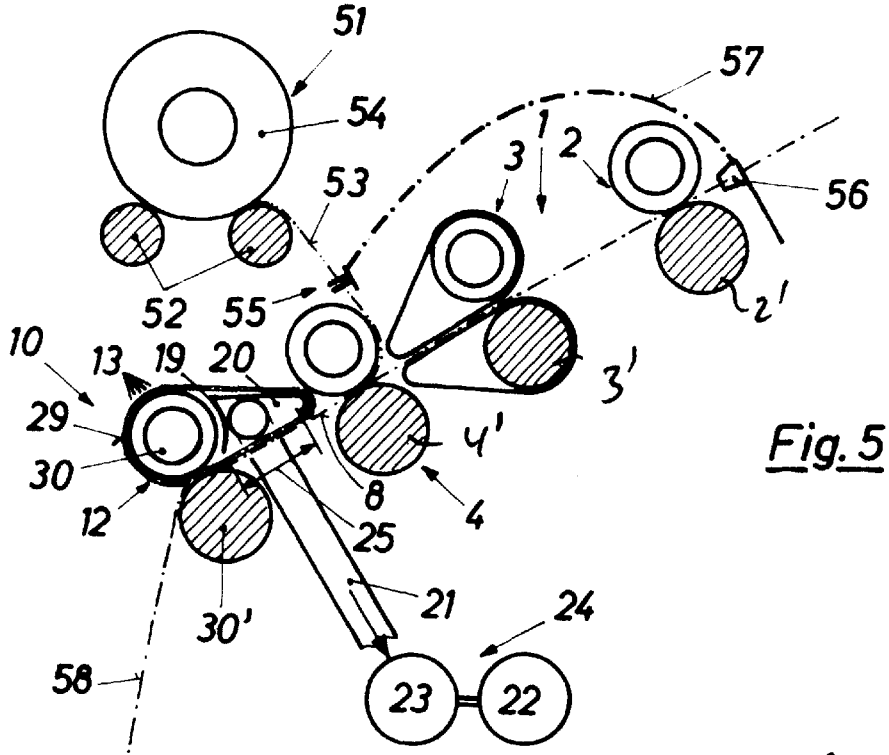

In the embodiment of FIG. 5, the compaction unit 10 is comprised of a suction belt 29 which passes around an upper roller 30. The upper roller 30 bears against a lower roller 30' which, like the rollers 2', 3' and 4', can extend the full length of the drafting frame and is driven.

The suction roller 29 has, in the manner already described, a row of perforations in the form of tiny intake openings or orifices 13.

Within the belt 29 a suction chamber 20 is formed by a shield 19 and is open from above toward the roving so that the suction effect can operate on the fibers of the roving through the perforations 12 in the belt.

Figure 6:
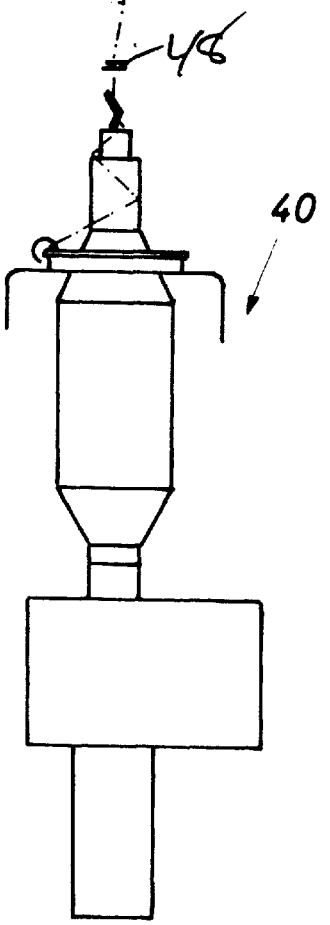
Figure 6:
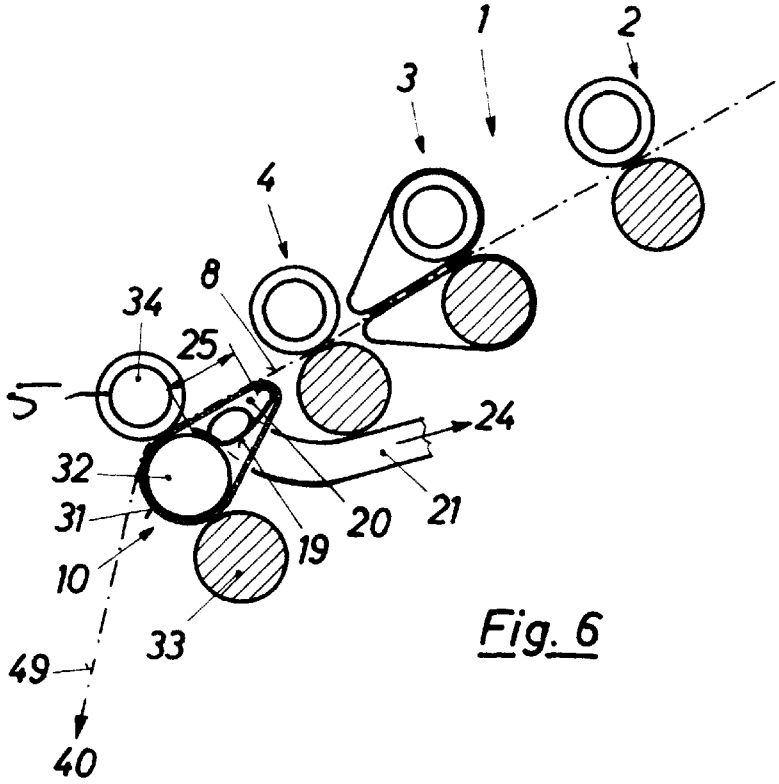

In the embodiment of FIG. 6, the suction belt 31 is located below the roving 8 and is looped around a lower roller 32. The lower roller 32 can be driven by the friction roller 33. A shield 19 in the lower belt 31 delimits the suction zone 25 as has been described and can be evacuated via the line 21 and the pumping system 24.

The lower roller 32 and the upper roller 34 juxtaposed therewith and provided with a jacket 5, can be provided as twin rollers and mounted on the arm 6. The belt 31 can also be composed of elastic material and the rollers can be composed of steel.

The belt 31 has perforations 12 applying suction to the roving and through which fibers of the roving are drawn together as the belt is driven during passage of the roving through the system. Twin roller arrangements for the rollers 32 facilitate replacement of the suction belt 31.

Figure 7:
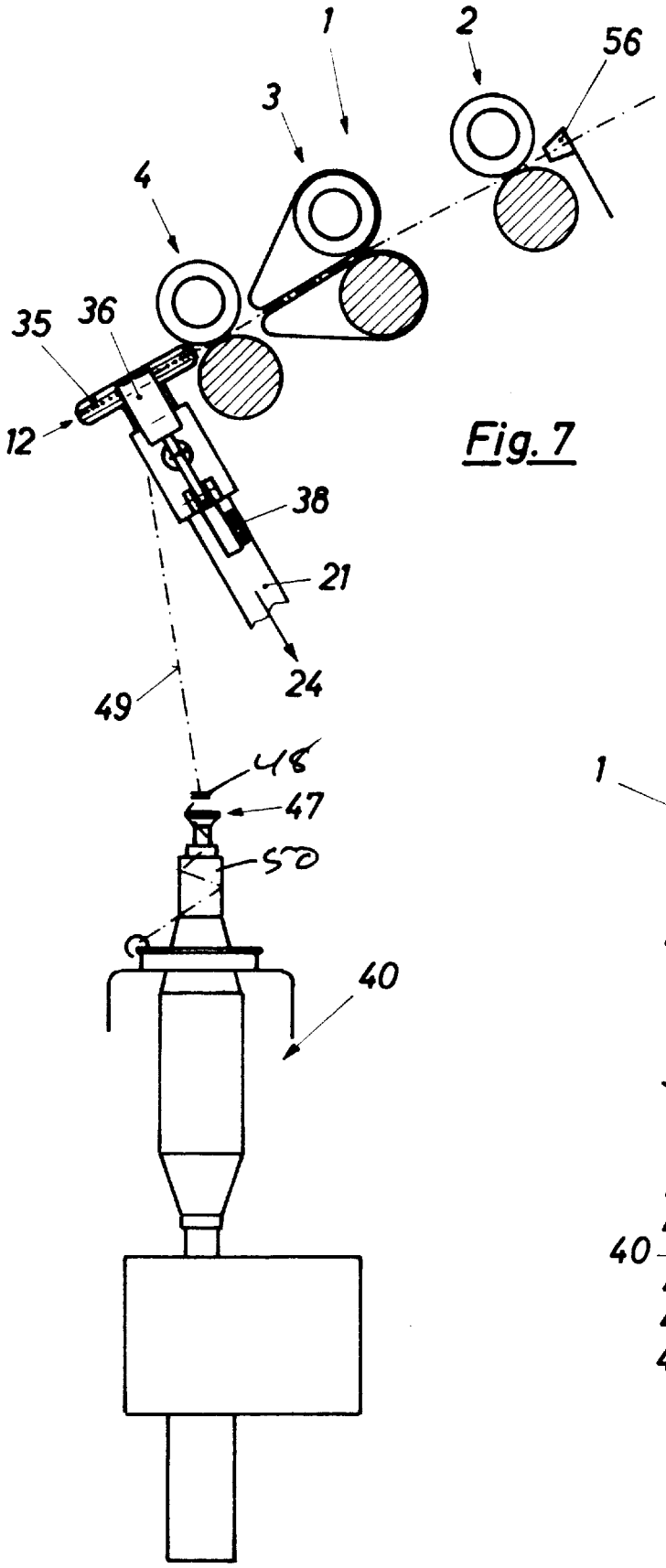
Figure 8:
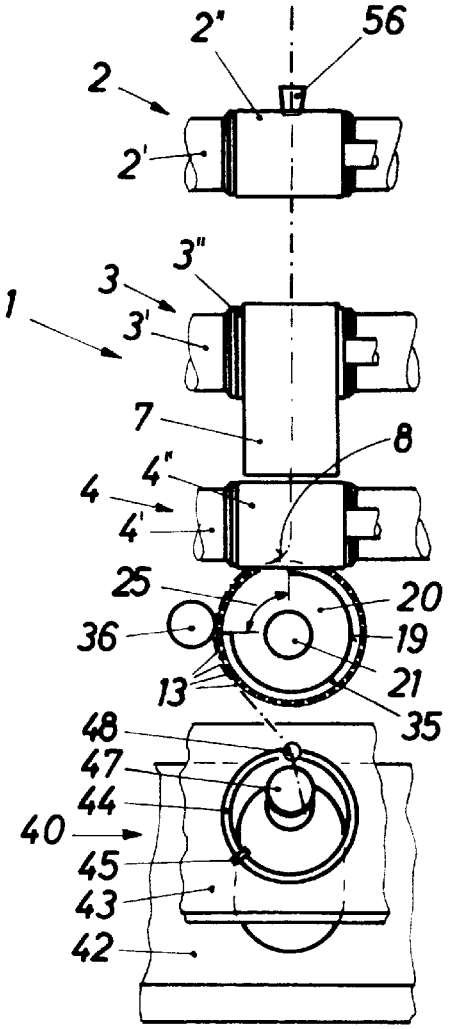
FIG. 8 is a diagrammatic and fragmentary top view of a portion of the apparatus of FIG. 7.

The suction condenser 10 can also be provided with a suction rotor 35 formed with perforations 12 along its periphery (see FIGS. 7 and 8). The suction rotor 35 is so oriented that its plane approximately coincides with the drawing or drafting plane so that the roving is picked up generally tangentially to this rotor. The latter reaches into the crevice between the output pair 4.

From FIG. 8 it will be apparent that the suction rotor 35, shown in section in FIG. 8, contains a suction chamber 20 connected to a suction source via the suction line 21 extending through the hollow axis or shaft of the rotor. A pressure roller 36 presses against the suction rotor 35 at the downstream end of the condensing zone, the upstream end beginning where the roving first contacts the suction rotor 35 in the aforementioned crevice. The roller 36 is biased against the periphery of the suction rotor 35 by a tension spring. The suction rotor 35 in turn can be driven by a tangential belt 38 in engagement with its hollow shaft.

The lower rollers 2', 3' and 4' of the drafting frame 1 and the driven lower rollers 14, 15, 26, 30' and 33 of the respective condensing units 11 are driven by the usual drafting frame drive represented at FIG. 1 and 39 at the requisite peripheral speeds. Of course individual drives which are coordinated with one another can be used for this purpose. In the embodiment of FIGS. 1–3, 5, 6 and 9 and 10, the lower rollers 15, 30' or 31, from which the rovings enter the location at which twisting is imparted to them, have a diameter which is suitable for handling the respective staple fibers, usually a diameter of 27 mm through 32 mm in the case of cotton.

The compaction device 10 is followed by a conventional ring spinning station (see FIG. 1) which usually is one of a large number of such stations arrayed along the same side of the spinning machine as that upon which the drafting frame is provided. Each spinning station can, as shown for the ring spinning station 40 in FIG. 1, can comprise a spinning spindle 41 which receives a core tube 41*a* on which bobbin 41*b* is wound. The spindle 41 is mounted on a spindle rail 42, common to the entire row of spindles and cooperates with a ring rail 43, likewise common to the multiplicity of spinning stations. Each spinning station has a respective spinning ring 44 upon which a traveller 45 can orbit.

According to the invention, balloon-free or low-balloon spinning is desired and, to this end, the spindle 41 can have a spinning finger 46 (FIG. 1) or a spinning crown 47 (FIG. 7) reaching close to a yarn guide 48. The twisted section is shown at 49 and runs in the case of the embodiment of 41 to the nip between the suction roller 11 and the driving roller 15 and in the case of FIG. 7, to the point at which the pressing roller 36 bears upon the suction rotor 35.

In operation, the drafting frame 1 delivers the drafted roving 8 at a width which is a function of the diameter of the supplied sliver and the drafting action of the successive pairs of drafting rollers, to the condensing unit in each case. The roving 8 is supported in the embodiment of FIG. 1, by the transport belt 16 of the condensing unit 11, 26, 29, 31, 35 (see also FIGS. 2–7). In the condensing zone 25, the roving 8 is subjected to suction through the perforations 12. Fibers which lie laterally are drawn together toward the row of perforations and the roving is thereby compacted.

The roving is supplied in this compacted state to the ring spinning station 40 and is stabilized by twisting and collected as a yarn body, e.g. as the bobbin 41*b*. The spinning finger 46 or the spinning crown 47 captures the yarn 49 directly at the thread guide 48 so that it is wound on the sleeve 41*a* or the sleeve 50 (FIG. 7) without the formation of a yarn or thread balloon or with a minimum thread balloon between that catcher and the traveler 45.

The apparatus can also be used to produce a core yarn and, for this purpose a core yarn forming unit 51 can be provided (see FIGS. 4 and 5).

Figure 9:
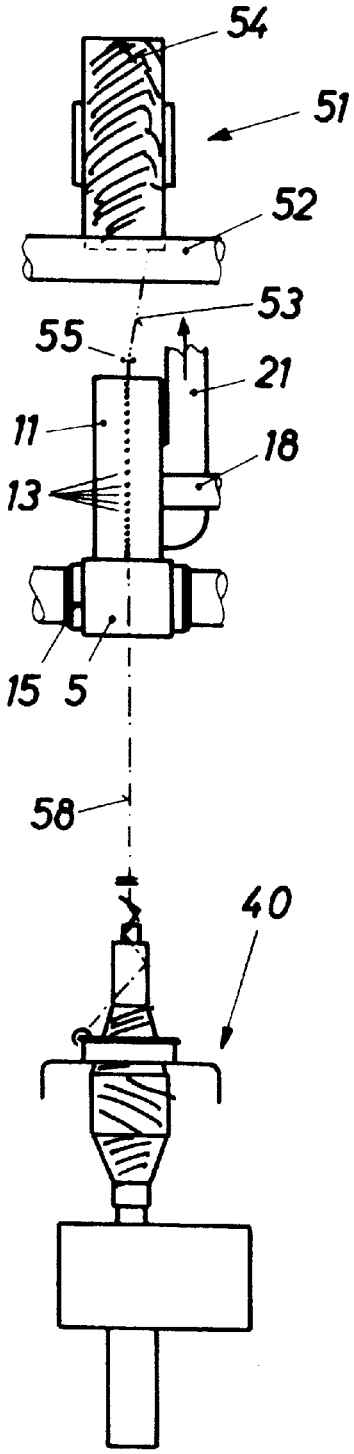
FIG. 9 is a fragmentary elevational view showing a modification of the system for use in the production of a core yarn.

The core yarn forming apparatus can comprise a spool 54 delivering a core thread or yarn 53 to the roving before a twist is imparted thereto. A core yarn will be understood to be a yarn in which an endless synthetic filament, referred to as a core thread, is covered with fibers from the roving, usually cotton or wool fibers, over its entire length. In the embodiments of FIGS. 4, 5 and 9, the drafting frame is provided in each case with two driven feed rollers 52 which can extend the full length of the drafting frame and upon which the respective core thread spools 54 for each station are mounted. The core threads 53 are then fed via thread guides 55 to the respective roving. The feed rollers 52 are driven at a lower speed than the peripheral speed of the output rollers of the output roller pair 4 so that the core thread 53 is stretched (2.5 to 5 times) before it meets the roving 8 at the speed at which the latter is fed out of the main drafting stretch between the role pairs 3 and 4.

FIG. 4 shows the possibility of feeding the core thread 53 directly to the condensing zone and hence around the upper roller 28 at the upstream end of the zone 25 into the nip between this roller and the suction roller 26. An elevational view of the core feeder 51 shown in section in FIG. 4 is found in FIG. 9.

The ability of the suction devices 11, 26, 29, 31 and 35 to apply suction to the roving 8 and draw the fibers thereof inwardly is limited. The roving 8 only moves back and forth to a limited extent but, to ensure that the core thread 53 will always meet the roving 8 centrally, the core thread guide 55 can be coupled to the sliver feed funnel 56 as represented by the dot-dash line 57. In this manner, the core thread is always laid centrally into the roving. Only in the embodiment of FIG. 7 in which a suction 35 is used can a roving of varying width be satisfactorily compacted. Of course a synchronization of the core thread guide with a device responding to change of width of the roving can also be used to ensure centering of the core thread on such a roving.

In any case, the core thread is already centered with respect to the roving at the beginning of the compaction zone 25 where the roving is relatively wide and thus the core thread is tightly and completely enveloped with the fibers of the roving to form the core yarn 58.

Figure 10:
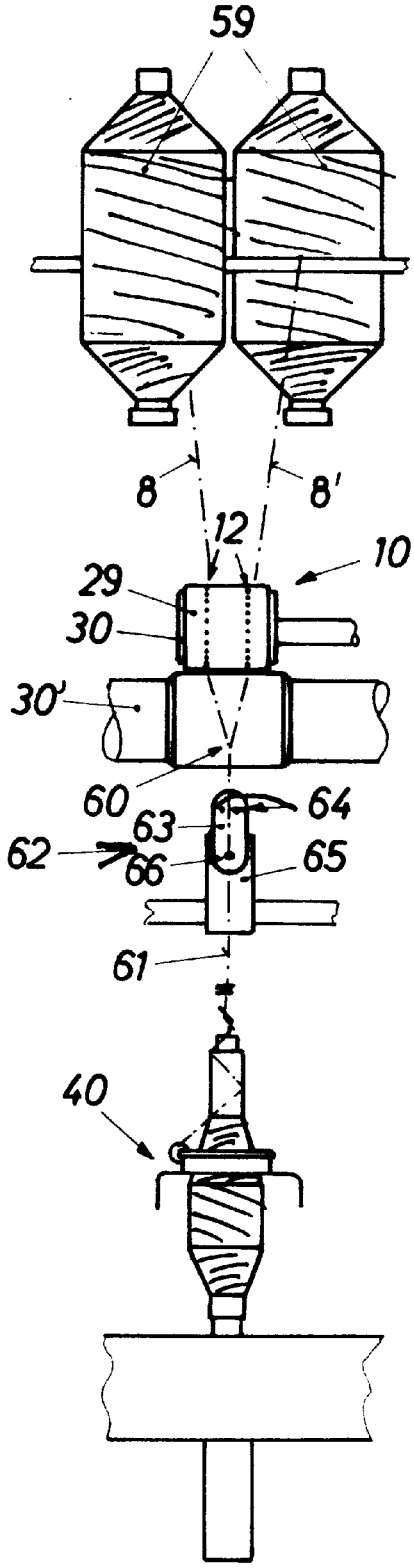
FIG. 10 is a view similar to FIG. 9 showing the production of a mock yarn.

Finally, FIG. 10 shows a system otherwise similar to FIG. 5 but which is utilized to produce a mock yarn. in this case, the suction belt 29 has a perforated periphery 12 with two rows of suction openings, each of which serves to condense a respective roving 8, 8' drawn from a respective supply 59. The separate and parallel-drafted rovings 8 and 8', without twist, are thus separately compacted and are united at 60 where a twist is imparted to them to yield the mock yarn 61.

So that a break in either of the rovings 8 or 8' will not result in continued wind-up of a defective mock yarn, a breakage device is provided in the form of a pivotal member 63 carrying a pair of pins 64 and swingable about an axis 66 on a support 65. The breakage unit 62 is designed so that, if one of the rovings breaks, the member 63 will swing and the pins 64 will loop the remaining roving and cause breakage thereof (see, for example, the commonly assigned copending-applications Ser. No. 09/285,586 and Ser. No. 09/285,434 filed concurrently herewith, Attorney's Docket No. 21048 and 21049).

We claim:

1. A method of producing yarn, comprising the steps of:

drafting roving in a drafting frame to produce a drafted roving;

thereafter compacting the drafted roving in a condensing device to obtain a compacted roving; and ring-spinning the compacted roving to twist the compacted roving while minimizing thread-balloon formation and to collect the compacted roving into a yarn body.

2. A spinning machine for producing yarn, comprising:

a drafting frame for drafting roving to produce drafted roving at an outlet pair of drafting rollers of said drafting frame;

a condensing device downstream of each of said outlet pair of rollers for compacting said roving to compacted roving;

a ring-spinning station receiving at least one of said compacted rovings for twisting thereof to form a yarn and for collecting yarn in a yarn body; and means at said station for minimizing thread-balloon formation in the twisting of said compacted rovings.

3. The spinning machine defined in claim 2 wherein said condensing device comprises a suction roller connected to a suction source and formed along a circumference thereof with a row of perforations, said circumference bearing upon the drafted roving for compacting same.

4. The spinning machine defined in claim 3 wherein said suction roller is disposed above said roving and rests upon at least one driven lower roller.

5. The spinning machine defined in claim 4 wherein said drafting frame has an output pair of rollers and said condensing device comprises a transport belt between said output pair of rollers and said suction roller.

6. The spinning machine defined in claim 5 wherein said transport belt is looped around one of said lower rollers.

7. The spinning machine defined in claim 2 wherein said condensing device comprises a suction belt engaging said roving and having a row of perforations opening toward said roving.

8. The spinning machine defined in claim 7 wherein said suction belt lies above said roving and is looped around an upper roller above a stretch field plane of the drafting frame.

9. The spinning machine defined in claim 7 wherein said suction belt lies below said roving and is looped around a lower roller below a stretch field plane of the drafting frame, an upper roller pressing said roving against said belt.

10. The spinning machine defined in claim 2 wherein said condensing device comprises a suction rotor having perforations and engaging said roving between an output pair of rollers of said drafting frame and said ring-spinning station.

11. The spinning machine defined in claim 2 wherein said means for minimizing thread-balloon formation in the twisting of said compacted rovings includes a spinning finger engaging said roving.

12. The spinning machine defined in claim 2 wherein said means for minimizing thread-balloon formation in the twisting of said compacted rovings includes a spinning crown engaging said roving.

13. The spinning machine defined in claim 2, further comprising means for feeding a core thread to said roving for envelopment by filaments thereof during twisting, thereby forming a core yarn.

14. The spinning machine defined in claim 2 wherein said condensing device feeds a plurality of untwisted compacted drafted rovings to said ring-spinning station for twisting thereby into a mock yarn.

* * * * *